US007407016B1

(12) United States Patent
Kvalo

(10) Patent No.: US 7,407,016 B1
(45) Date of Patent: Aug. 5, 2008

(54) GRADING BOOT ATTACHMENT

(76) Inventor: Corey A. Kvalo, 4866 Pine Spring Rd., DeForest, WI (US) 53532

( * ) Notice: Subject to any disclaimer, the term of this patent is extended or adjusted under 35 U.S.C. 154(b) by 431 days.

(21) Appl. No.: 11/093,061

(22) Filed: Mar. 29, 2005

Related U.S. Application Data

(60) Provisional application No. 60/558,447, filed on Mar. 31, 2004.

(51) Int. Cl.
*E02F 3/76* (2006.01)

(52) U.S. Cl. ..... 172/784; 172/786; 37/281

(58) Field of Classification Search ..... 172/810, 172/811, 815, 816, 817, 818, 820, 239, 781, 172/782, 784, 786; 37/216, 270, 274, 280, 37/281

See application file for complete search history.

(56) References Cited

U.S. PATENT DOCUMENTS

| | | | | | |
|---|---|---|---|---|---|
| 1,333,504 | A | * | 3/1920 | Monroe | 172/782 |
| RE16,200 | E | * | 11/1925 | Adams et al. | 172/782 |
| 1,568,439 | A | * | 1/1926 | Baxter | 172/784 |
| 1,586,230 | A | * | 5/1926 | Walters | 172/782 |
| 1,782,992 | A | * | 11/1930 | Johnson | 172/782 |
| 2,646,633 | A | * | 7/1953 | Jahn | 172/782 |
| 2,991,570 | A | * | 7/1961 | Resler | 172/784 |
| 3,148,466 | A | * | 9/1964 | Batko | 172/781 |
| 3,216,337 | A | * | 11/1965 | MacDonald | 404/104 |
| 3,231,991 | A | * | 2/1966 | Evert et al. | 37/280 |
| 3,374,562 | A | * | 3/1968 | Glesmann | 37/280 |
| 3,430,706 | A | * | 3/1969 | Marron | 172/815 |
| 4,215,495 | A | | 8/1980 | Wagner | |
| 4,479,312 | A | * | 10/1984 | Turgeon | 37/219 |
| 4,707,936 | A | | 11/1987 | Steinhoff | |
| 4,834,191 | A | * | 5/1989 | Vecchio | 172/784 |
| 4,837,940 | A | | 6/1989 | Mahan | |
| 5,375,349 | A | | 12/1994 | Jochim | |
| 5,758,728 | A | * | 6/1998 | Ragule | 172/815 |
| 5,848,654 | A | * | 12/1998 | Belcher, Jr. | 172/815 |
| 6,363,631 | B1 | * | 4/2002 | Cordingley | 37/280 |
| 6,463,683 | B1 | | 10/2002 | Skwarchuk | |
| 7,051,819 | B1 | * | 5/2006 | Schenk | 172/815 |

* cited by examiner

*Primary Examiner*—Thomas B. Will
*Assistant Examiner*—Joel F Mitchell
(74) *Attorney, Agent, or Firm*—M. Paul Hendrickson

(57) ABSTRACT

The present invention provides a grading boot attachment which when attached to a roadway grading moldboard allows for more accurate and uniform grade cutting or leveling with the moldboard. The attachment includes amounting plate for mounting to the moldboard, a winged section and an adjustable leveling gate which may be adjusted to the appropriate angular position for any desired task. A compressive strut retains the leveling gate in an operable position.

20 Claims, 11 Drawing Sheets

GRADING BOOT ATTACHMENT

This application is a non-provisional application of earlier filed provisional application No. 60/558,447 entitled "Grading Boot Attachment", filed on behalf of Corey A. Kvalo on Mar. 31, 2004.

FIELD OF INVENTION

This invention relates to an attachment for a grading blade and more particularly to a grading boot attachment and the method of its use.

BACKGROUND OF THE INVENTION

In paved road construction, it is common practice to establish a compacted roadbed using a scraper blade to scrape the road bed surface at a proper roadbed depth. Procedurally, the compacted roadbeds are typically prepared from a rock base comprised of gravel or stone which must then be leveled and compacted to the appropriate height before paving with a suitable top surface such as concrete or blacktop which typically mates onto the gutter of the curbstone. Within recent years, there have been developed sonic and laser tracking devices which attach to a road grader. These tracking devices typically include a transducer which generates laser beams or sound pulses which enables the tracking device to measure the roadbed depth and control the grade with physical reference to base lines such as a curbline surface, a string line, or other existing road surface landmarks. This provides an appropriate road bed for laying the concrete, black top or other surfaces onto the road bed. These sonic or laser tracking devices are designed to include software and hardware which automatically adjusts the grader moldboard to the appropriate grading height so as to provide the proper rock bed grade prior to the laying of the finished road bed surface. Exemplary of such sonic or laser devices which measure and control the roadbed grading elevation are referenced in an owner's manual entitled the BLADE-PRO™ Motorgrader Control System, copyrighted 1992, Spectra-Physics Laserplane, 5475 Kellenburger Road, Dayton, Ohio, and an operator's manual entitled Motorgrader System Five™ by TOPCAN Laser Systems, Inc., 5758 W. Las Positas Blvd, Pleasanton, Calif. 94588, both of which are incorporated herein by reference.

In order to prepare a suitable road bed for paving, the finished rock bed grade must be within ¼ inch tolerance so as to meet mandated road building engineering specifications. This will normally require a number of passes before the roadbed meets the required specifications. A major problem with such sonic and laser measuring devices is the fact that the monitoring measurement relies upon the perceived curbstone flag or gutter surface as a guideline to control the elevation of the moldboard. Unfortunately, if, in fact, there exists any debris from past grader passes upon the curbstone gutter surface (e.g. such as gravel) then the automated reading for positioning the grading moldboard will become grossly distorted. The sensing device will react to the more elevated debris resting along the targeted beam line causing the moldboard to be inaccurately raised to an inaccurate grading elevation. Accordingly, the perceived evaluation of the curb control line becomes distorted by whatever debris may be resting upon the curbstone gutter surface. It is customary to initially manually sweep graded materials from the curbstone flagging so as to permit the sonic or laser measuring devices to record an accurate measurement of the actual distance between the rockbed and the curb flagging edge. Conventional grading moldboards will accordingly inherently sweep excessive or unwanted material onto the curbstone flagging or gutter. This in turn distorts the true curbline depth resulting in automatic adjustment of the moldboard to an excessive amount of road bed abutting onto the curbstone and places the road bed in non-compliance with road building specifications. The need to constantly sweep graded debris from the curbstone flagging increases the costs, manpower, equipment and time needed to complete a roadway project. The advantage of a grader moldboard regulated by an automatic sensing device can be readily frustrated by an inability to maintain the targeted beam line in condition for an accurate reading. There also exists a need to more accurately control the amount of material cut or graded along the leading edge of the moldboard as well as being able to more accurately and more uniformly control the distribution of graded material along the trailing edge of the moldboard. The ability to effectively limit graded spill and unwanted debris at a moldboard grading edge would significantly enhance the efficacy of moldboard grading.

The present invention provides an attachment which alleviates the problems attendant to the conventional use of the grading moldboard. The present attachment serves as a moldboard attachment to accurately cut and grade the roadbed while maintaining and preventing accumulation of debris onto the curb or work site. The attachment provides a more uniform and accurate distribution of graded material. This allows the sonic or laser measuring device to provide an accurate and more uniform control of the moldboard in a grading operation.

SUMMARY OF THE INVENTION

The present invention provides a grading boot attachment adapted for securence onto a moldboard of a road grader. The grading boot attachment attaches to an outside end margin of a moldboard and extends outwardly from the grading edge of the moldboard. The grading boot attachment includes a leveling gate which effectively controls the flow of graded material flowing along the leveling gate. Unwanted spillage of unleveled material at the terminating grading end or side of grading moldboard is thus eliminated through use of the grading boot attachment of this invention. In a grade cutting situation wherein the attachment is used as a leading edge, a more uniform cut and removal of graded material occurs. When the moldboard is primarily used to deposit material along the trailing edge, the deposition of material is more uniformly and accurately controlled.

The grading boot attachment appropriately includes a base mounting plate having a mounting section of a contour mating onto the moldboard and fitted with mounting slots for bolting the attachment onto the moldboard, a fixed winged section extending outwardly from the mounting section at an obtuse angular disposition, an adjustable hinged leveling gate hinged onto the winged section, a leveling gate retaining member such as an adjustable chain anchored or adjustably linked to the leveling gate at one end and anchored or adjustably linked to the moldboard at an opposite end so as to limit outwardly movement of the leveling gate and a restraining member or compression strut such as a compression spring which applies an opposing force against the leveling gate. The leveling gate retaining member serves to limit the maximum angular positioning of the leveling gate for optimum grading efficacy while the leveling gate restraining member prevents it from collapsing to a non-leveling position.

The grading boot attachment is particularly useful for use in combination with automated depth sensing and regulating devices in roadbed grading operations. Unexpectedly superior graded material flow and controlled placement of graded material without creating false readings by reason of unwanted grade spillage upon curbstone site may be accomplished by the combined use of such automated sensing devices with the grading boot attachment of this invention.

DETAILED DESCRIPTION OF THE INVENTION

Figure 1:
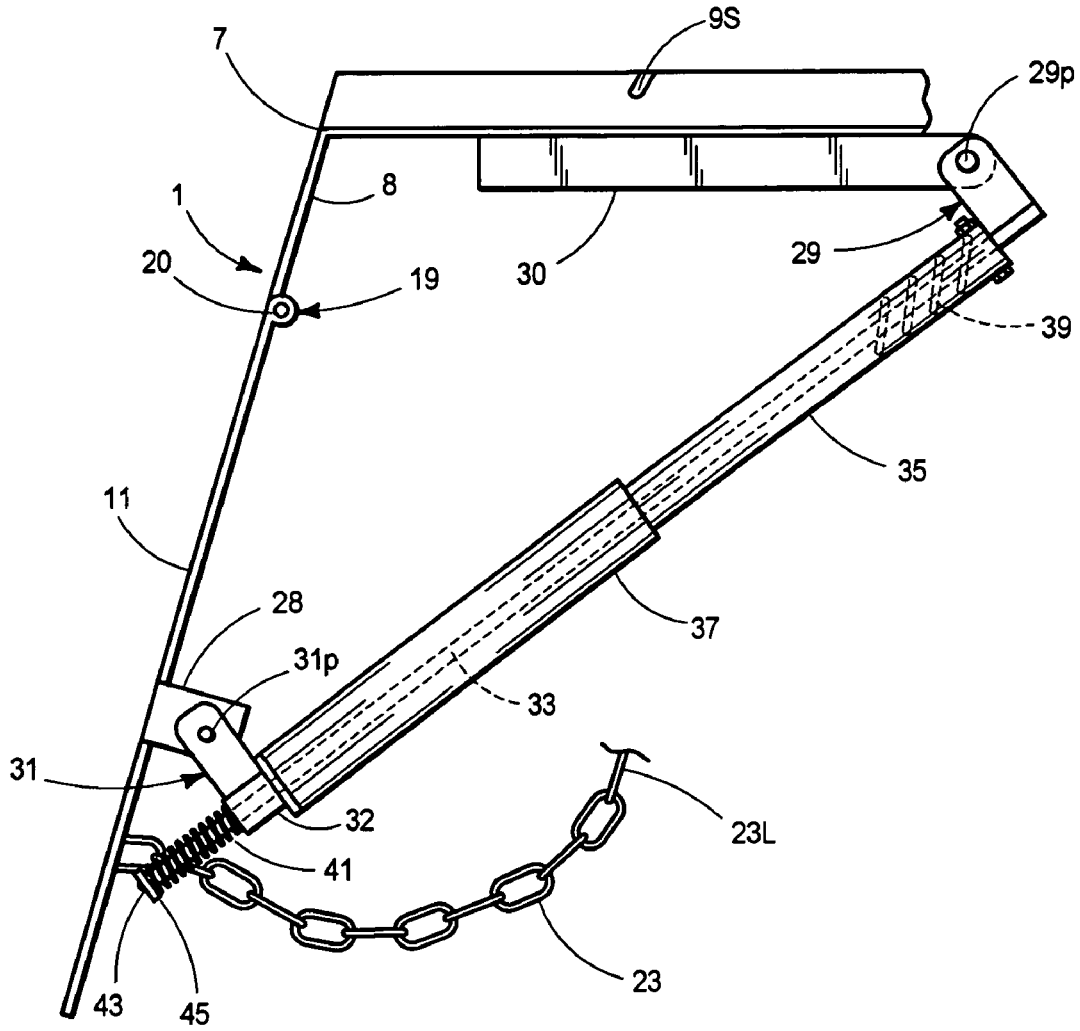
FIG. 1 is an unmounted top view of the grading boot attachment of this invention.
Figure 2:
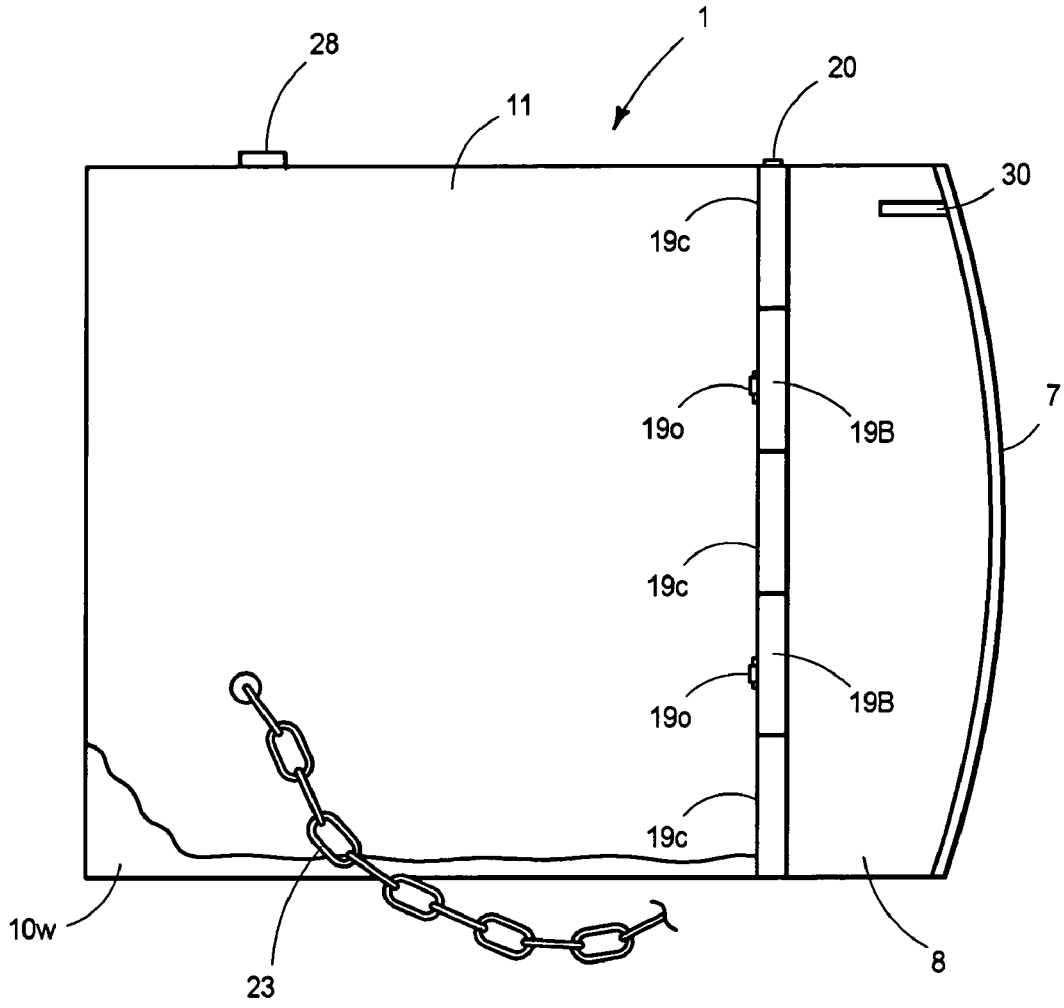
FIG. 2 is a side view of the grading boot attachment shown in FIG. 1.
Figure 3:
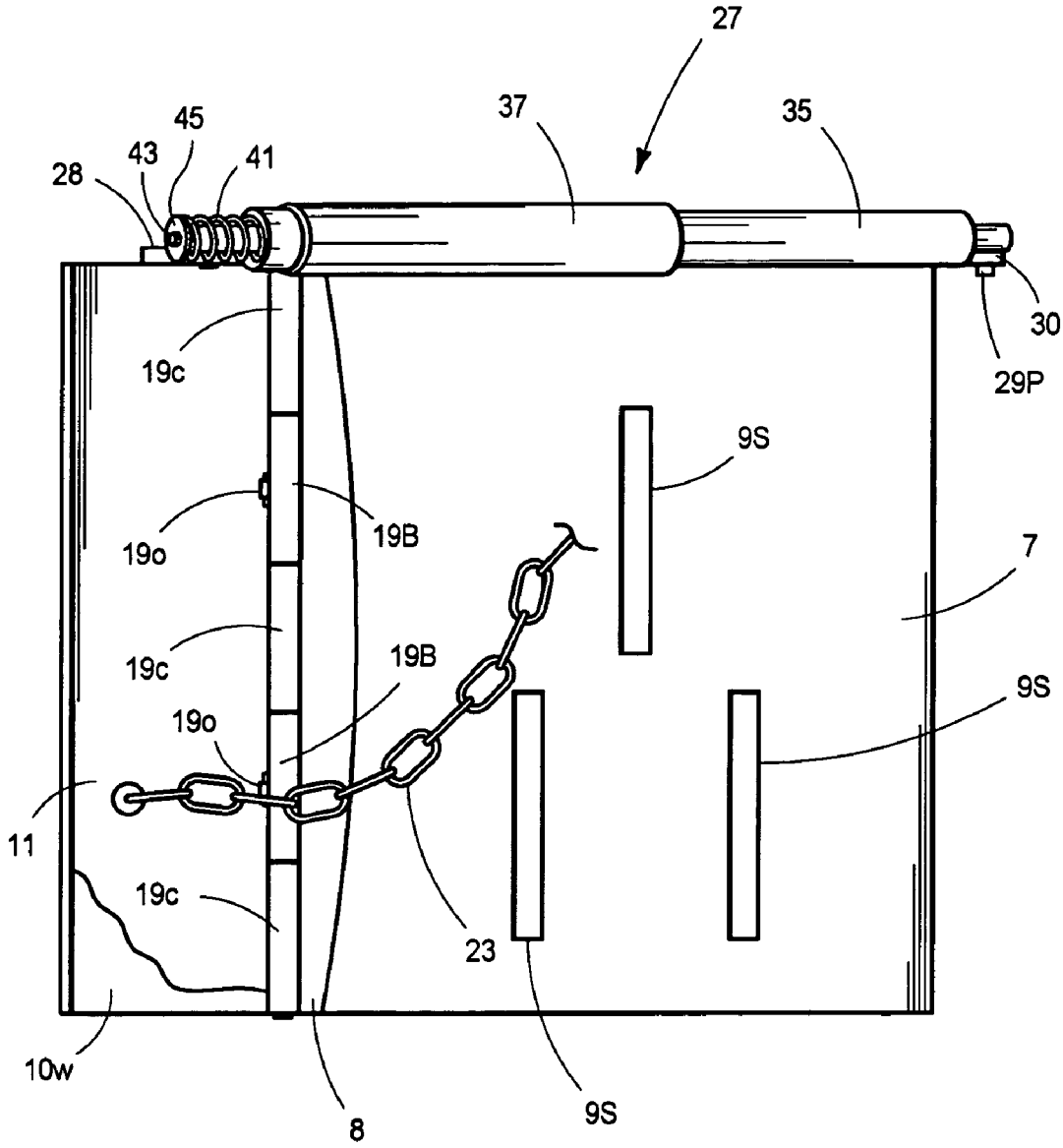
FIG. 3 is a front view of FIG. 2
Figure 4:
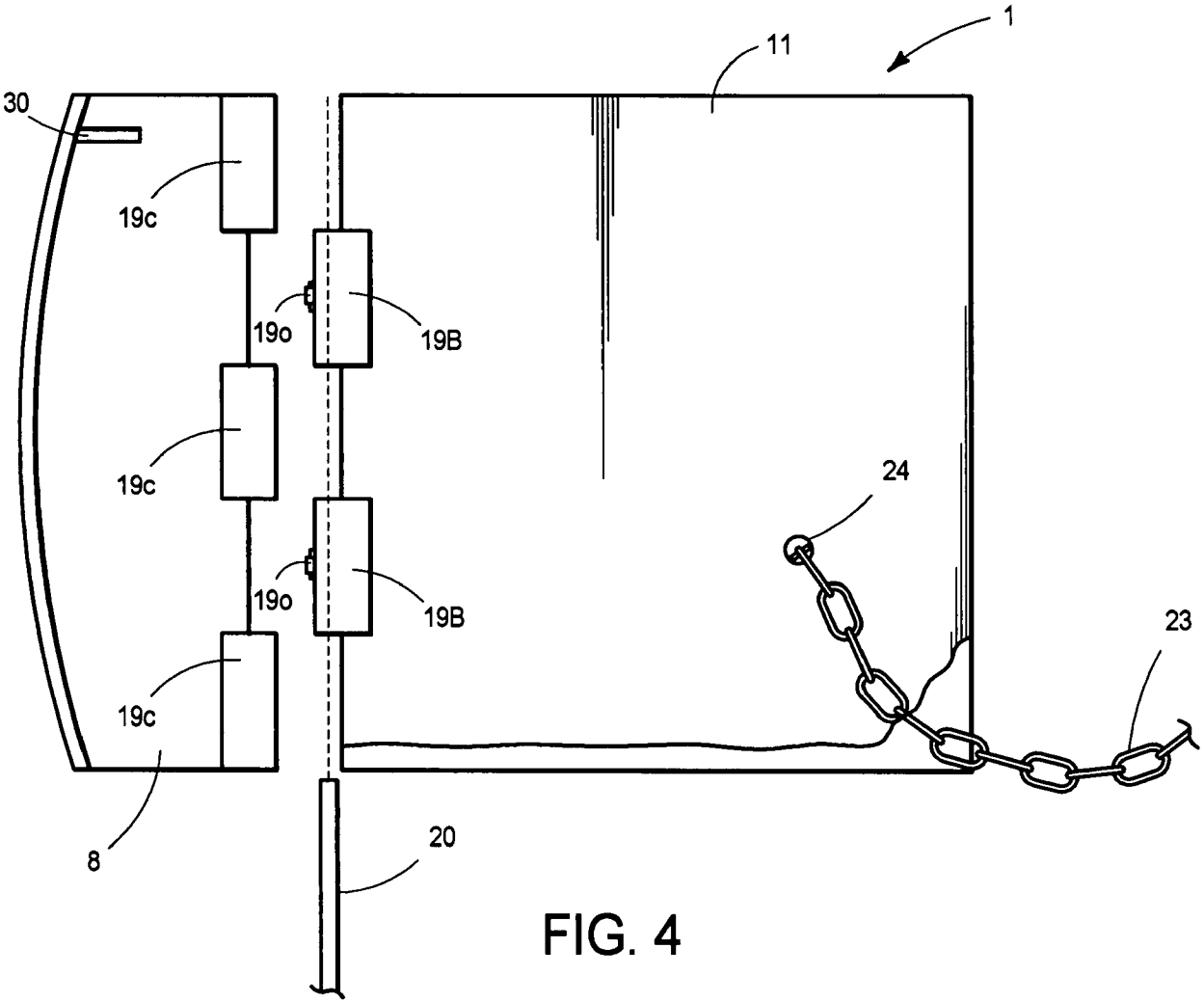
FIG. 4 is an exploded view of the hinge assembly for the leveling gate of the boot attachment shown in FIG. 1.

With reference to the FIGS. 1-13, there is generally provided a grading boot attachment 1 adapted for mounting onto a grading moldboard 3 of a road grader 5. The grading boot attachment 1 comprises a base mounting plate 7 equipped with mounting members (generally prefixed by 9) for mounting the grading boot attachment 1 to the moldboard 3, a winged section 8, an adjustable leveling gate 11 pivotally carried by said winged section 8 and adjustable means 23 for adjusting the angular disposition of the adjustable leveling gate 11 to a desired leveling gate position. The leveling gate 11 may be adjusted to a variety of variable positions to meet the particular grading requirements for any particular grading task. Grading efficacy of the attachment is significantly enhanced by an operationally fixed wing section 8 which extends outwardly from the mounting plate 7 at an obtuse angle.

Figure 10:
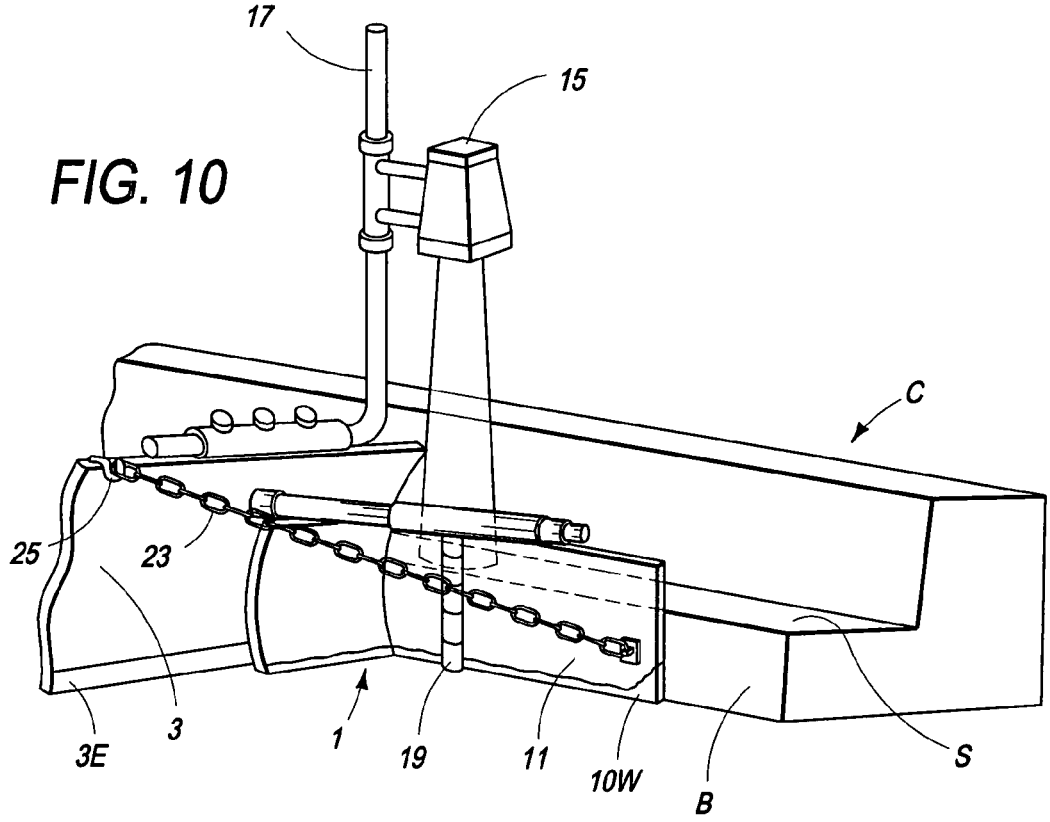
FIG. 10 depicts a fragmentary frontal side view of FIG. 9 showing the attachment of this invention mounted to the left leading edge of a moldboard equipped with sensing device shown in FIG. 9.
Figure 11:
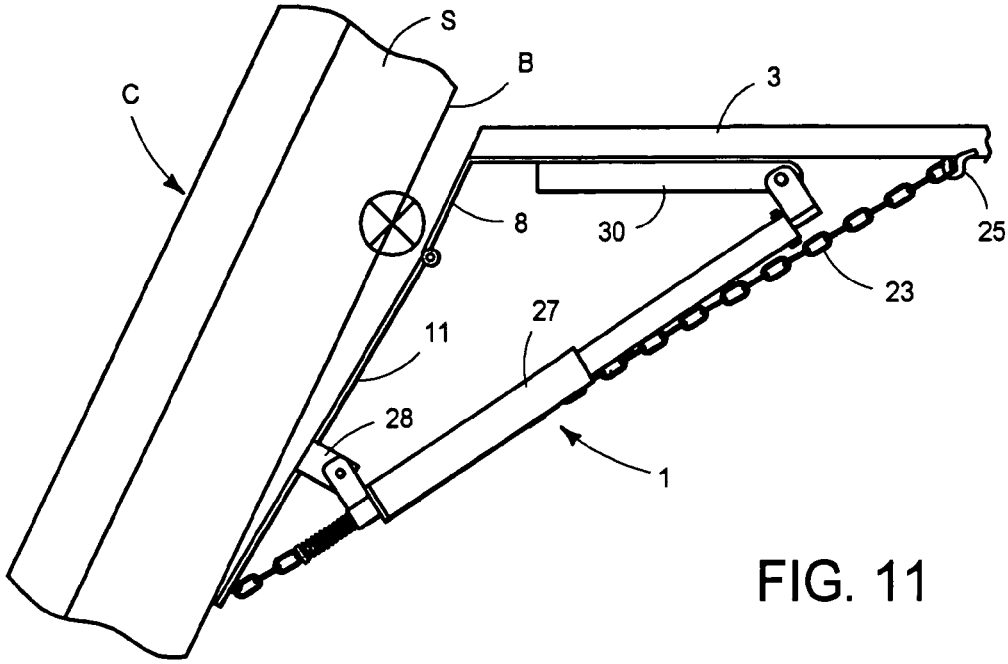
FIG. 11 is a top view depicting the leveling gate of the mounted attachment shown in FIG. 10 with the leveling gate retaining chain adjusted to a 120 degree leveling gate angular position with the leveling gate forward edge shown as abutting against a curb base inner wall.
Figure 12:
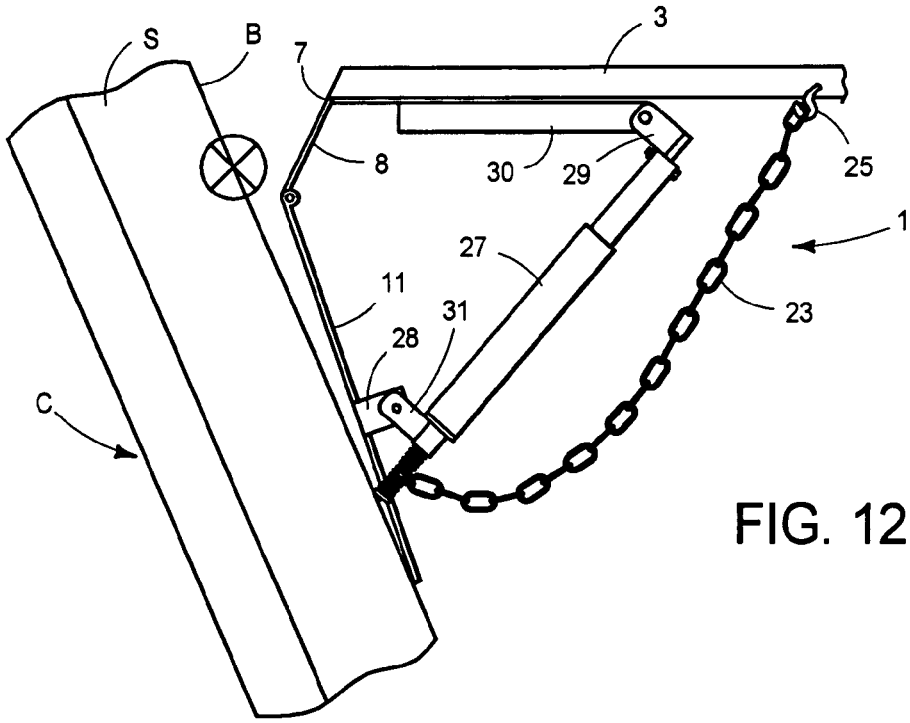
FIG. 12 is a top view of FIG. 10 showing the attachment mounted to the grader moldboard except that the moldboard has been repositioned so that the leveling gate has been operationally positioned against the curb base inner wall at a 45 degree angular leveling gate pitch to fill graded material onto the curb base inner wall.

The grading boot attachment 1 controls the flow of material graded by the moldboard 3 of a road grader 5. The attachment controls the manner in which graded material is distributed along the trailing edge of the moldboard 3. Conversely, when the attachment 1 serves as the leading edge of the moldboard 3, it more accurately controls the uniformity of the cut. The grading boot attachment 1 may be mounted at either end of the moldboard 3 depending upon which side (left or right) it is desired to use the grading boot attachment 1. The mounting members (generally prefixed by 9) allow the grading boot attachment 1 to be easily attached and detached from the moldboard 3 as well as adjusted to a grading plane in alignment with the grading plane of the moldboard 3. FIGS. 1-3, 6, 8B, 8A and 11-13 depict the grading boot attachment 1 attached onto the right end margin of a moldboard 3. FIG. 10 depict the attachment 1 mounted to the left side of the moldboard 3. The restraining strut 27 depicted in FIG. 5 may be used for either a right or left moldboard 3 mounting of the attachment 1. The positioning of the mounting bolt apertures 9*o* of the concave mounting plate 9P shown in FIG. 7 are positioned so as to match a left hand moldboard mount. Repositioning the mounting bolt apertures 9*o* to mate the right hand moldboard bolt mounts renders the FIG. 7 concave mounting plate 9P suitable for a right mount. As may be observed, the left side attachment 1 is a mirror image of the right mounted grading boot attachment 1. When mounted upon the moldboard 3 with mounting members 9 such as with the mounting bolts 9B and the mounting plate 9P, the grading boot attachment 1 and the leveling gate 11 are designed to place the bottom grading edge of the attachment 1 in linear or grading alignment with the grading blade edge 3E of the moldboard 3. Thus, the leveling gate 11 allows the grading boot attachment 1 to cut or grade material at the same grading elevation level or tilt as the moldboard 3. The positioning of the attachment 1 at the leading or trailing edge will depend upon the manner in which the moldboard 3 is being used to grade the roadway. When grading to the precise measurement required for a curb fill, the adjustable grading and leveling gate 11 enables the grader operator to uniformly distribute and control the flow of graded material along the trailing edge of the moldboard 3. During the grading operation, the grading and leveling gate 11 can be adjusted to an appropriate leveling gate position within about the 45 degree to about the 120 degree angular orientation so as to more precisely control the flow of graded material following along the trailing edge or leveling edge of the moldboard 3. The ability to control this flow of material allows the operator to more precisely control the amount of graded material deposited and distributed along the trailing edge of the moldboard. FIGS. 10-13 illustrate operational adjustment of the leveling gate 11 to a 45 degree, 120 degree, and 90 degree leveling (includes cutting) positions, which positions reflect the operational angular positioning of leveling gate 11 in relationship to its planar or angular alignment to the moldboard 3. The adjustable grading and leveling gate 11 allows the gate 11 to be adjusted from an acute angle (e.g. 45 degree) to an obtuse angle (e.g. 120 degrees) so as to permit adjustment of the gate 11 to any angular position to meet the requirements of any desired task. The adjustable gate 11 allows the operator to grade along a finished surface such as a curb C and pivotally adjust the moldboard 3 so it is angled onto the curb C allowing material to flow onto the gate 11 and towards the curb C. As the moldboard 3 is pivotally adjusted towards the curb C, the angle of the grading and leveling gate 11 is correspondingly reduced. The moldboard 3 can be typically rotated or angled towards the curb C to place the gate 11 in an inwardly position approximating 40 degrees. This allows the operator to grade material next to the curb C or edge without spilling of the graded material onto the flagging surface S. When operating curb C side, the most effective use of the attachment 1 is accomplished by placing the leading tip of the gate 11 flushly against the curb base B as illustrated in FIGS. 10, 11 and 12.

The accompanying FIGS. 8A and 10-13 illustrate in part, the versatile use of the grading boot attachment 1 in combination with a road grader 5 equipped with a conventional sonic or laser regulating device 15 designed to control the elevational positioning of the grading moldboard 3. The grading boot attachment 1 when attached to an outer margin (either left or right) of the moldboard 3 (preferably in conjunction with the automated depth sensors and control 15) serves to uniformly grade and control the flow of the rockbed or graded material to an appropriate roadbed depth for a roadway.

When operating curbside, the leveling gate angular retaining member 23 may be chained to provide the desired 120 degree angular position for pushing fill onto the trailing edge (i.e. onto the leveling gate 11 as illustrated by FIG. 11). In FIG. 12, the leveling gate retaining member 23 is chained a the 120 degree position while the grader operator relies upon the curbside base B to close the leveling gate 11 to a leveling or trailing edge deployment for filling along curb base B.

Figure 8B:
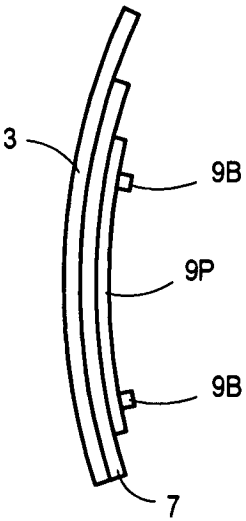
FIG. 8B is a cross-sectional view taken along line 8B-8B in FIG. 6 showing the boot attachment shown attached to the moldboard.
Figure 8A:
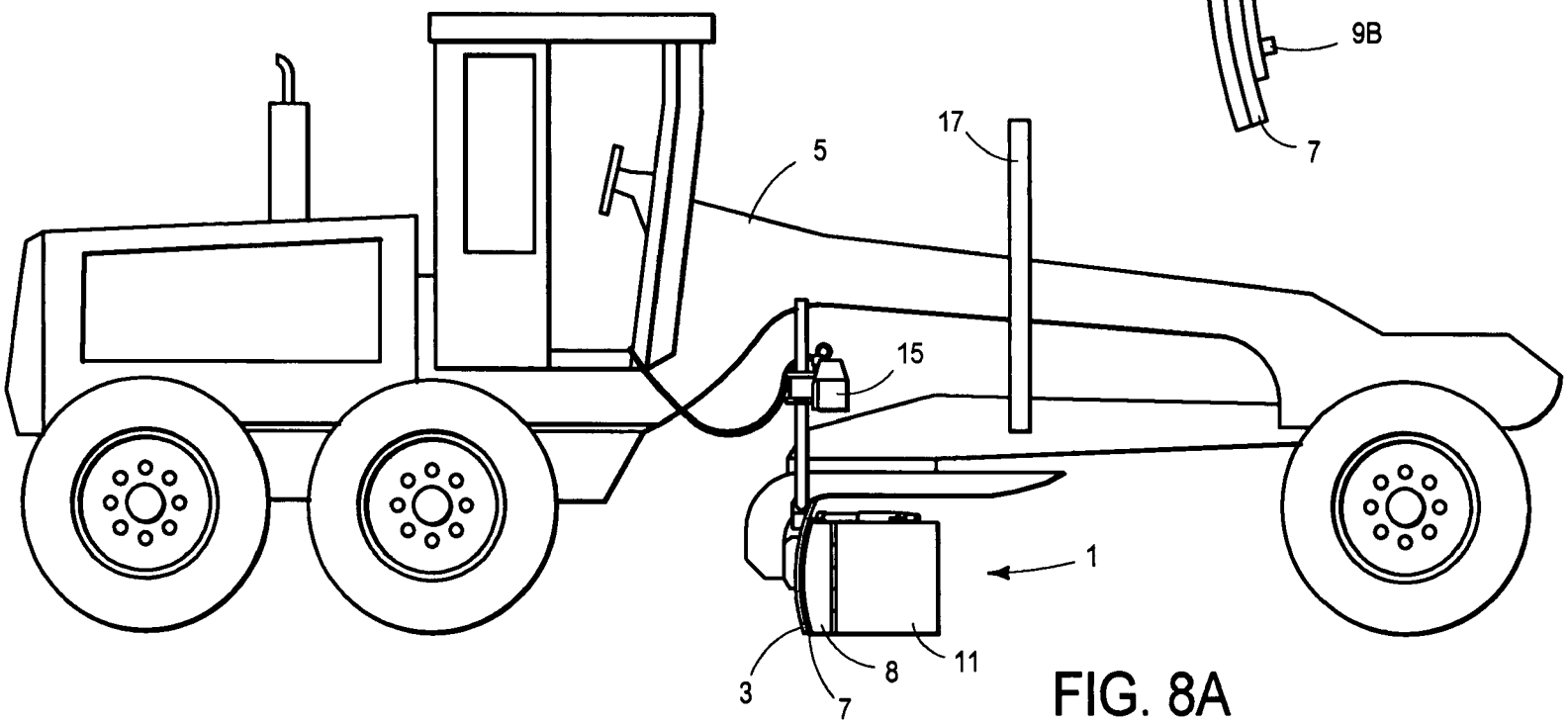
FIG. 8A is a side view of the attachment shown in FIG. 1 mounted to a road grader equipped with an automated depth sensing and moldboard regulating device and the attachment being adjusted to a perpendicular grading position.
Figure 9:
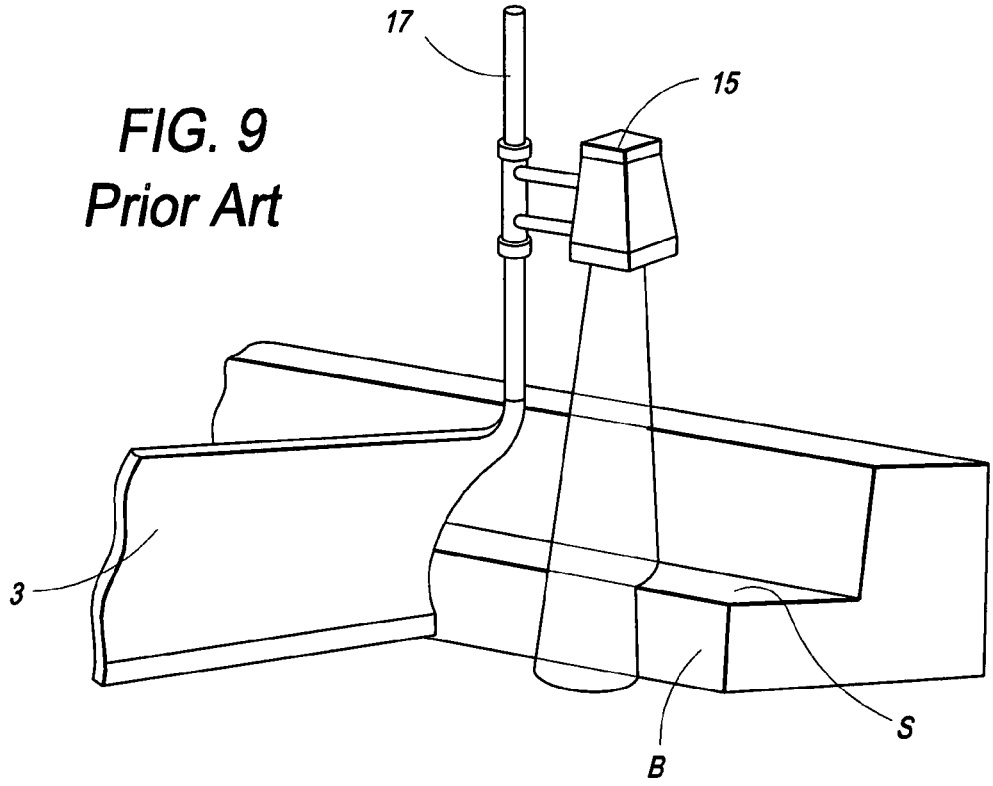
FIG. 9 Prior Art
FIG. 9 is a partial elevational view depicting a moldboard equipped with an automated depth sensing device as currently used by the prior art.

As illustrated by view of prior art FIG. 9, it is conventional to use a plumb pole 17 which serves as a mounting pole for mounting a sonic tracking device 15 which is designed to automatically regulate the moldboard grading depth. FIGS. 8A and 10-13 illustrate the adjustable use of the leveling gate 11 when the attachment 1 is mounted to a moldboard 3 of a grader 5 equipped with a sonic tracking device 15 and plumb pole 17. When using the grading boot attachment 1, the sonic tracking device 15 is mounted to the plumb pole 17 and positioned so that the sonic signal will create tracking signal or position slightly outwardly and behind the leveling gate hinge 19 as depicted in FIGS. 8A and 11-13. If the sonic signal is positioned to close to the winged sections 8 or leveling gate 11, an erroneous signal will be dispatched to the sensing device 15. In curbstone use, the sensing signal targets the curb flagging S sufficiently removed from the operational use of the attachment 1 so that the attachment 1 does not interfere with the signal. In a grading operation without the grading boot attachment 1, the grader operator places the outside moldboard 3 edge flushly against the street side curbstone as shown in FIG. 9 which aligns the sonic sensor in alignment with the outermost side of the curbstone lip edge.

In curbstone use, without the grading boot attachment 1 of this invention, the graded material will accumulate upon the curbstone flagging S (i.e. curbstone gutter surface) causing the sonic or laser measuring and regulating device 15 to create a false reading as to the actual grade depth. The attachment 1 of this invention prevents the accumulation of debris (e.g. gravel, etc.) upon the curbstone gutter S and thereby permits a consistently accurate measurement and control of the grading moldboard 3 when used in combination with roadway grader sensing devices 15. Without the grading boot attachment 1 of this invention, the grader operator in a curbside operation must typically maintain the outer most edge of the grading moldboard 3 flushly against the curbstone base B as shown in FIG. 9. This frequently leads to chipping and breakage of the curbstone base B or gutter surface S as well as causing excessive outer edge wear upon the moldboard 3. The present grading boot attachment 1, when attached to grading moldboard 3 for curbside use as depicted by FIGS. 8A and 10-12, enables the grader operator to operate the grader 5 within a broader working range by allowing the moldboard leading or trailing edge to be distanced up to about 6 inches from the curbstone base B while still maintaining an accurate road bed grade and preventing road bed gravel and other debris from accumulating upon the curbstone gutter S. In operational use, it may also be necessary to fill or cut material with the operator consistently changing the moldboard 3 orientation to meet these roadway tasks as the road work proceeds. The use of the grading boot attachment 1 substantially reduces undue operator stress since its use avoids the constant attention required to constantly maintain the moldboard tightly against the curbstone during the final preparation of the road bed for paving.

Figure 13:
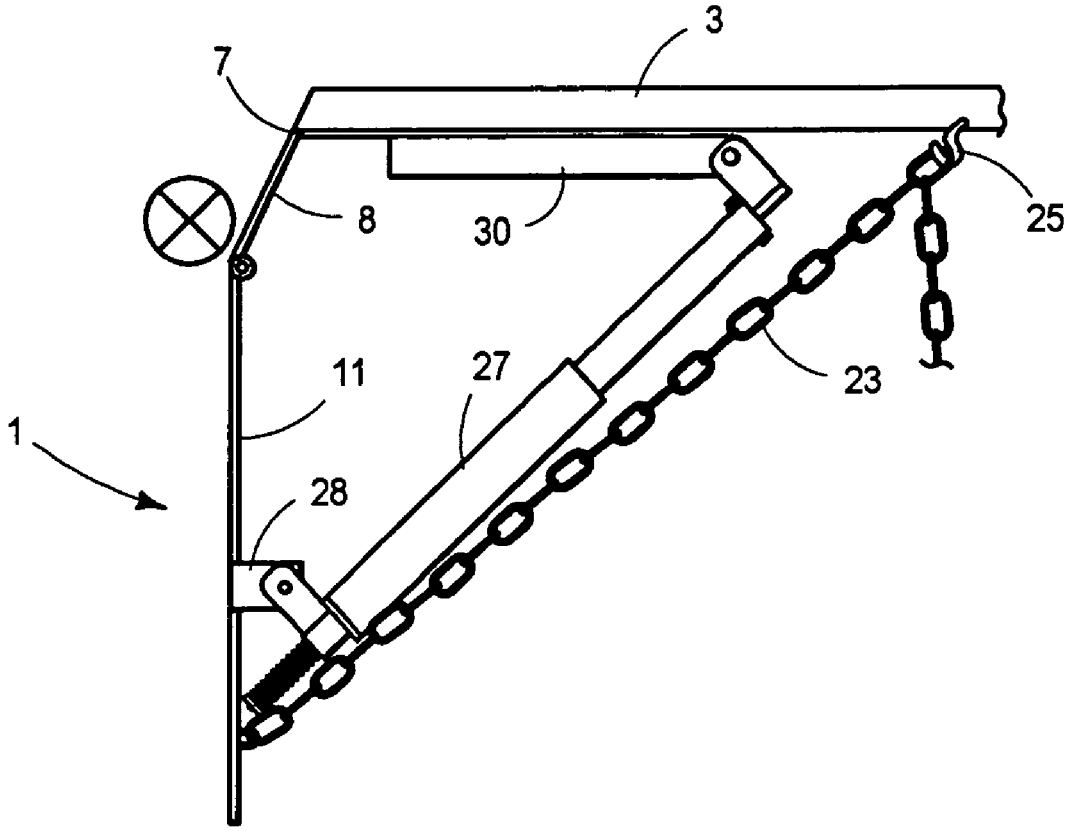
FIG. 13 is an elevational view of the mounted attachment shown in FIG. 11 with the leveling gate being operationally positioned at a 90 degree angular relationship to the moldboard edge.

In an embodiment of the invention as depicted in the accompanying Figures, the base mounting plate 7 includes a contour mating onto the interfacing surface of the moldboard 3. A fixed winged section 8 rigidly secured to the mounting plate 7 and most appropriately disposed at an obtuse angular disposition to both the mounting plate 7 and the moldboard 3 serves to support the leveling gate 11. The winged section 8 will typically be disposed at about a 105 to about 115 degree angular orientation from the mounting section 7 and the mounted grading plane of the moldboard 3. An angular displacement of the fixed wing at about 115 degrees as depicted in FIGS. 11-13 has been found to be particularly effective for use in grading operations.

The adjustable leveling gate 11 is hingeable or pivotally mounted to the fixed winged section 8. The bottom edge of the mounting plate 7, the winged section 8 and the adjustable leveling gate 11 are all mounted in planar alignment so as to provide a straight or level grading edge with the moldboard 3. Since the bottom or grading edge of the mounting plate 7, the winged section 8 and the leveling gate 11 will undergo considerable wear with usage, a case hardened wear weld 10W is placed along the entire bottom or grading edge of these attachment 1 components. The leading tip of the leveling gate 11 is likewise prone to curbside and graded material wear and is equipped with the case hardened wear weld 10W as depicted in the Figures.

The grading and leveling gate 11 is variably adjustable (e.g. typically about 40 to 120 degrees) relative to the moldboard 3 so as to allow the gate 11 to push rockbed or base material against or away from the curbstone. The gate 11 is depicted as being pivotally mounted so as to vertically extend outwardly the planar surface of the fixed winged section 8. A hinged joint 19 comprised of hinge bushings 19B & 19C welded onto the interfacing edges of the winged section 8 and the gate 11 serve to house hinge pin 20 and impart the desired durable hinging effect of the gate 11 to the winged section 8. The hinge bushings 19B & 19C may be suitably equipped with grease fittings 19*o* so as to permit periodic greasing of the hinged joint 19.

The adjustable grading and leveling gate 11 is positioned at the appropriate leveling gate position by an adjustable angular retaining member 23. The adjustable retaining member 23 may consist essentially of any retaining member 23 which adjusts the gate 11 to the desired grading and leveling gate position. When the grading and leveling gate 11 and moldboard 3 are used to cut or remove material along the leading edge, the normal flow of material against the gate 11 tends to exert an outwardly biasing force against the gate 11. In the absence of a bracing or stopping object such as a curbside, the biasing force is held in check by the adjustable angular retaining member 23. Although adjustable hydraulically controlled cylinders may be used for this purpose, the gate retaining member 23 will accordingly advantageously prevent outwardly movement to a predetermined outward grading and leveling gate position but allow for inward movement of the grading and leveling gate during its operational use. If the grader operator should be operating the gate 11 against a curbside C as depicted in FIGS. 10-12, the adjustable retaining member 23 will advantageously allow the gate 11 to close to smaller angular disposition when applying curbside pressure against the gate 11 as particularly illustrated by FIG. 12. The adjustable retaining member 23 thus serves to limit the outermost swing or arc of the gate 11 during a grading operation. Accentuated controlled hydraulic cylinders with an outwardly movement stop while providing some inward play may be effectively used for this purpose. The retaining chain 23 as depicted in the drawings serves as an inexpensive as well as a highly effective adjustable leveling gate retaining member 23. The depicted retaining chain 23 is attached at one end to the grading and leveling gate 11 by chain mount 24 and to a chain hook 25 securely anchored to the top edge of the moldboard 3. The appropriate gate 11 angular positioning may accordingly be easily achieved simply by emplacement of the appropriate chain link 23L in the chain hook 25 so as to retain the gate 11 at the desired angular gate 11 position which in turn prevents any further backward movement of the leveling gate 11 during the grading operation. Alternatively, other adjustable retaining members 23, such as push type hydraulic and air cylinders, may also be used to control the angular disposition of gate 11.

In the embodiment of the invention as shown in FIGS. 1, 3, 5-6, 8A, and 10-13, the grading boot attachment 1 includes a gate restraining strut 27 which prevents or restrains the gate 11 from movement to a closed or non-grading position. If during the grading operation, the graded material should exert sufficient pressure to force the gate 11 against the moldboard 3 or to angular disposition less than about 30 angular degrees, the grading and leveling gate 11 has effectively moved to a closed or non-grading position and accordingly loses its effectiveness. This restraining operation may be effectively incorporated into the design of the leveling gate retaining member 23 and as previously mentioned the gate restraining strut 27 may be specifically designed for this purpose. The gate restraining strut 27 permits the gate 11 to close to a lesser angular disposition while still maintaining it at an operative grading position.

As illustrated in the Figures, the gate restraining strut 27 may be pivotally secured at one end to the leveling gate 11 with a leveling gate strut mount 28 while also being pivotally mounted at an opposite end to a mounting plate strut mount 30 so as to accommodate for operative changes in the leveling gate 11 position with a mechanism which limits (typically by compression and expansion) contraction of the hinged leveling gate 11 from movement to a substantially closed position. In operation, this allows the gate restraining strut 27 to compress and expand within its pivotal mounting sites 29 & 31 to accommodate operational movement of the leveling gate 11. The pivotal mounting of strut 27 is completed by leveling gate strut mount 28 and a mounting plate strut mount 30 for pinning strut 27 to the leveling gate 11 to the mounting plate strut mount 30 with mounting pins 29P & 31P. The strut 27 includes a strut mounting plate mount bracket 29 at one strut end and a strut leveling gate mounting bracket 31 at the opposite strut end fitted with strut receiving apertures 29A & 31A for receiving strut mounting pints 29P & 31P. A strut guide shaft 33 supportively extends along the entire length of strut 27. The strut 27 includes mounting pins 29P & 31P which when pinned onto strut pin receiving apertures 29A & 31A secure the strut 27 to pivotal mounting brackets 29 & 31. Pivotal mount bracket 31 houses a strut shaft bushing 32 which allows for slideable movement of extended guide shaft 33 therewithin. The restraining strut 27 is shown as being equipped with a pair of telescoping cylindrical housings 35 & 37 which house a biasing spring 39. The biasing spring 39 which is disposed between pivotal mounting brackets 29 & 31 compresses and expands as pressure is applied or released against the leveling gate 11. As the adjusting chain 23 is tightened, the biasing spring 39 compresses within the cylindrical housings 35 & 37 between pivotal mounts 29 & 31 which in turn exerts an outwardly counterforce serving to prevent the strut 27 from inwardly collapsing to the extent the leveling gate 11 becomes operationally ineffective. Sleeve 37 (e.g. a 11 inch×1.75 inch I.D. steel pipe welded to frame strut mounting bracket 31) serves to slideably engage onto inner plastic pipe sleeve 35 (e.g. 11 inches by 1.630 inch O.D. and 1.5 inch I.D.) to protectively house biasing spring 39 and strut guide shaft 33. At the opposite strut end, the inner plastic sleeve 35 is bolted to guide shaft 33 by strut sleeve bolt 27B and threaded nut 27N. The distal mounting bracket 29 mates onto a leveling gate strut mount 28 which projects inwardly along the top margin of leveling gate 11 and includes a pin receiving aperture occluded from view for pivotally pinning the leveling gate strut mounting bracket 28 to distal strut mounting bracket 31 with mounting pin 31P.

In order to prevent separation of the cylinder housings 35 & 37, a closure spring 41 secured by a threaded bolt 43 and a retaining washer 45 at the distal end of strut shaft 33 constrains the biasing spring 39 and confining the cylinders 35 & 37 between pivotal mounts 29 & 31. Although the leveling gate strut 27 restraining mechanism is depicted as a compression spring 39, other mechanical components such as gas or hydraulic charged struts adjustable to variable pressures such as used in automotive air shocks may also be used for this purpose.

Figure 5:
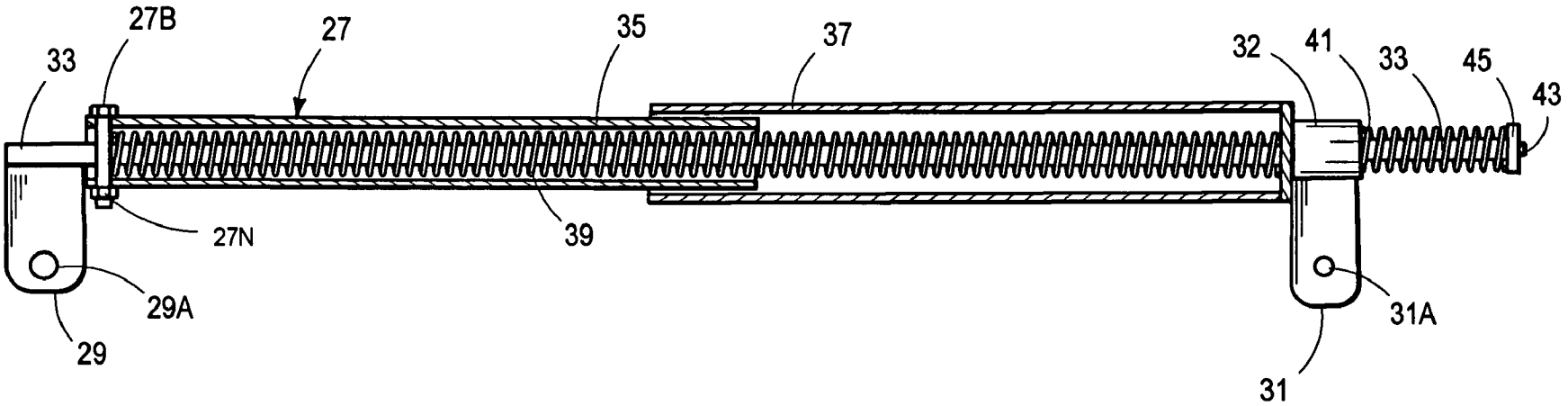
FIG. 5 is an enlarged cross-sectional view depicting a gate retaining strut shown in FIG. 1.

The compression spring 39 may comprise two springs each measuring 12 inches in length with an O.D. of 1.5 inches, I.D. of 1.176 inches, rating rate of 8.5 pounds/inch, wire diameter of 0.162 inch and a total of 27 coils for each spring. The two biasing or compression springs were tandemly slipped onto a one inch diameter strut shaft 33 for assembly of the completed strut 27 as shown in more explicitly by the cross-sectional view of FIG. 5. When assembled into the completed strut 27, compression springs 39 exerted a slight amount of biasing force against the pivotal strut mounting brackets 29 & 31. The closure spring 41 supported by strut guide shaft 33 is confiningly housed between strut distal mounting bracket 31 and closure spring washer 45 anchored to the shaft 33 distal end by washer 45 and washer retaining bolt 43. The closure spring 41 is fabricated by cutting an identical 12 inch spring to that as used for a biasing spring to a length of 3½ inches and assembled onto the strut 27 as shown in FIG. 5. The closure spring 41 maintains the entire spring mechanism under tension and maintains the strut guide shaft 33 in an operable condition to handle the compression and decompression functions of the strut 27.

Although the grading boot attachment 1 may be mounted upon road graders 5 without automated controls to improve upon grading efficacy, it is especially adapted to work on graders 5 equipped with automated moldboard control systems 15. When grading a city or subdivision street with installed curbs, the gravel base typically needs to be graded along the curb site to the desired elevation and slope. This will typically require a number of passes with the curbside edge of the moldboard 3 being placed as a leading edge (i.e. for cutting or removing material) or often as a trailing edge (i.e. to deposit or fill material curbside) as needed to complete the curbside roadbed for paving. This operation is repeated again to complete the paving operation.

For operational use of the grading boot attachment 1 in a grader 5 equipped with a sonic tracker or laser system 15, a mounting pole 17 which also serves as a plumbing pole is typically installed onto the moldboard 3 as more fully shown in FIGS. 8A and 10. In operation, the cutting edge or blade 3E of the moldboard 3 is adjusted to rest upon a smooth surface and the moldboard 3 is tilted forward until the bottom of leveling gate 11 is squared onto the ground. In the operational embodiments of the invention as depicted by FIGS. 8A and 10-13, the sonic tracker 15 is mounted and set so that its signal or beam tracks inline with the moldboard cutting edge at a target site slightly behind and outside the hinge joint 19 as illustrated in FIGS. 10-13. In operation of tracking along the lip of the flagging surface S, the sonic tracker 15 monitors and maintains the moldboard blade 3E at the desired elevation. By tilting the moldboard 3 to keep the sonic tracker and the mounting pole 17 plumbed, the bottom of the edge of the leveling gate 11 may be effectively utilized to cut at the same elevational level as the moldboard cutting edge 3E. When the sonic tracker 15 is used in connection with the grader's slope control system, the only two adjustments needed to effectively grade the surface involves a steering adjustment and adjusting the cutting angle of the moldboard 3. At this targeting position, the tracking beam clears the winged section 8 to target the lipped edge of the flagging S and inner curbstone base B.

When grading with the grading boot attachment 1 and sonic tracker and slope control 15 combination, less spillage occurs on each finished surface and fewer grading passes are required to finish the job. Without the boot attachment 1, graded material will inherently spill on the curb flagging gutter surface S and the sonic tracker 15 will upon subsequent passes erroneously track the spilled curb surface material instead of tracking the lipped curb flagging surface S. As mentioned, flagging debris will cause the sonic tracker 15 to excessively raise the moldboard 3 resulting in an excessive deposit of graded material in response to an incorrect grade measurement.

The grading boot attachment 1 may also be effectively adapted for the grading of inverted alleys and streets which allows run-off water to drain at to the roadway centerline. While fine grading of an inverted street with the grading boot attachment 1 of this invention, the retaining chain 23 is typically set so that the leveling gate 11 rests at 90 degrees or at perpendicular relationship to the moldboard 3 as illustrated by FIG. 13. Customarily, the most common automated grader sensing systems will rely upon a sonic sensing system 15 for regulating roadbed depth while relying upon a laser automated sensing system for the automated slope control of the moldboard 3. In grading an inverted street, the grading boot attachment 1 is operated from center of the street with the inside moldboard edge 3E being manually operated and the outer moldboard edge 3E being automatically controlled by the laser system. In operational use, the moldboard 3 with the attached attachment 1 may be rotated as needed. For example, if too much material is in the flow line (i.e. the center of alley or street), the moldboard 3 will need to be rotated outwardly and tilted slightly backwardly. Whenever the leveling gate 11 is used as a leading edge, the leveling gate 11 will more uniformly grade and distribute the excess graded material along the trailing moldboard edge 3E. This creates a more uniform grade than can be accomplished without the grading attachment 1 of this invention. The leveling gate 11 when rotated outwardly and titled slightly backwardly will then effectively function as a regulating gate allowing material to flow under the leveling gate 11 without spilling onto the other blade side. The tilt of the moldboard 3 will necessitate periodic adjustment when the amount of cut changes. In inverted street operations, the leading leveling gate 11 will serve to uniformly cut and grade excessive material along the flow line and uniformly distribute the excess material onto the trailing moldboard edge 3E. The operational use of the boot attachment 1 allows for a more uniform surfaced inverted street while significantly minimizing the number of passes to complete the finished grade.

The grading boot attachment 1 is also highly effective for grading curbless roads, driveways, and paths. The preparation typically involves creating an elevated centerline by grading in opposite directions to create the desired roadbed and finished pavement. This may be effectively accomplished by adjusting the leveling gate 11 to a 90 degree angular position or right angle position to the moldboard 3 as illustrated by FIG. 13 and then using the leveling gate 11 as a trailing edge in the grading operation. By keeping the leveling gate 11 full of material along its outermost edge or trailing edge, a perfect grading edge can be created without leaving an excess windrow of material. The leveling gate 11, when used in this manner, creates a sharp or even roadway pavement edge of a substantially uniform thickness in contrast to the normal feathering of material along the roadway edge as customarily produced by the conventional use of the moldboard. At a street end after each pass, the operator can simply turn the grader 5 around and grade in an opposite direction with the leveling gate 11 being appropriately positioned at the opposite roadside edge without any further adjustments. This allows the grading boot attachment 1 to provide a perfect finish on both edges of the street. In the grading process, the trailing edge of the moldboard 3 is equipped with the grading boot attachment 1 and the sensing device 15 is turned onto automatic slope control to hold the slope at the desired roadway pavement grade.

If the attachment 1 is used in conjunction with a 14 feet wide moldboard 3 and the path or roadbed to be graded is only 12 feet wide, the boot attachment 1 needs to be closed down by retaining the leveling gate 11 to a more closed position as illustrated in FIG. 12 with the retaining chain 23, however, being tautly secured to hold the leveling gate 11 at about 40 degrees. This will maintain the leveling gate 11 at approximately 40 degrees. If the moldboard 3 is rotated so the boot attachment 1 is at the trailing position, the grade will be at 12 feet in width. An additional pass in the opposite direction should be performed to control the width and to achieve an uniform edge of the road surface. The boot attachment 1 can be chained inwardly to 90 degrees as shown in FIG. 13 and used to shoulder along paved roads to keep gravel at a consistent width.

FIGS. 10-12 illustrate an effective manner of using the adjustable leveling gate 11 to create a quality curbside roadway. The attachment 1 allows the curbside task to be completed more quickly and effectively than can be accomplished without the attachment 1. As comparatively depicted by FIGS. 11 and 12, the leveling gate 11 may be operationally adjusted to an acute angular leveling gate position with or without the retaining chain 23 (e.g. 40 degrees as depicted by FIG. 12) or at an obtuse angular leveling gate position (e.g. 120 degree leveling gate position) as depicted by FIG. 11. In a curbside use, the leading or trailing edge of the leveling gate 11 is placed against or in juxtaposition to the inner sidewall base of the curb B as illustrated in FIGS. 10-12. If it is desired to fill graded material against the curb base inner sidewall, the leveling gate 11 is positioned in a trailing position and the leveling gate 11 is positioned at an acute angular leveling gate position as illustrated in FIG. 12.

If it is desired to remove graded material from the curb C site, then the leveling gate 11 is placed in a leading edge position with the leveling gate 11 being adjusted to an obtuse angular leveling position (e.g. 120 degrees) as illustrated by FIG. 11. Irrespective of whether the leveling gate 11 is used to remove or grade material onto the curb C site, the leveling gate 11 effectively eliminates spillage of graded material onto the curb flagging S. This avoids the need to sweep graded material from the curb flagging S with each pass of the roadway grader 5 and the possibility of any erroneous signals being received by the sensing device 15.

FIGS. 10 and 11-12 also depict a most suitable mount and positioning of the sensing device 15 when used in combination with grading attachment 1. With particular reference to encircled x (i.e. ⓧ) depicted in FIGS. 11 and 12, the sensing device 15 signal should be set so that it targets the flagging S topside slightly outside from the hinged section 19 of the grading attachment 1. The sensing device 15 accepts the highest elevational point in direct alignment with the aimed signal. If the signal is aimed too close to the leveling gate 11 or the winged section 8, the signal will adversely distort the elevational level of the curb flagging S.

There always exists in the normal operation of a roadside grader 5 a potential of damaging the moldboard or curb C. The design and construction of the present attachment 1 avoids the possibility of damaging either the curb C or moldboard 3 during the normal operation of the roadway grader 5. As may be observed from FIGS. 1, 3, 5-6, 8A and 10-13, the gate restraining strut 27 will allow the outermost edge of the leveling gate 11 to move inwardly upon sufficient force to compress compression spring 39. Thus instead of damaging either the curb or moldboard 3 during operational use, the normally damaging force simply forces the leveling gate 11 inward to a workable and undamaged position. When the force against the leveling gate 11 is released, the gate restraining strut 27 simply forces the leveling gate 11 to return to its outermost chained leveling gate position. Neither the curb nor the attachment is damaged in this operation.

The combination gate retaining member 23 and the compressive gate restraining member 27, the operator is afforded a wider operational latitude than may be accomplished with a conventional moldboard 3. If the roadway grader 5 should position the leveling gate 11 to firmly against the curb base B, the leveling gate 11 will be forced inwardly sufficiently to accommodate for the excessive positioning of the leveling gate 11 against the curb base B. This is accomplished without adversely effecting the curbside grade. The roadway grader can accordingly deviate up to about six inches from the curb site without adversely changing the quality of the grading operation. Stress is also reduced and the effectiveness of roadway grading operation is significantly enhanced. By the same token, the roadway operator may effectively utilize the compressive mechanism of the strut 27 to change from an obtuse angular leveling gate position to an acute leveling gate position when operating the attachment 1 against the curb C side. For example, should it be desirable to change from a material removal or cutting setting at an obtuse angular leveling gate position to an acute angular leveling gate position so as to add an uniform fill to the curb side, the operator may simply bias the leveling gate 11 against the curb side base B (as illustrated by FIG. 12) while altering the attachment 1 from a leading to trailing moldboard position. When it becomes necessary to return to grade removal stage, the operator may then move the leveling gate 11 away from the curb side so that the strut 27 returns the leveling gate 11 to it original obtuse angular leveling gate position and allow for moldboard 3 adjustments to accommodate for the change.

Figure 6:
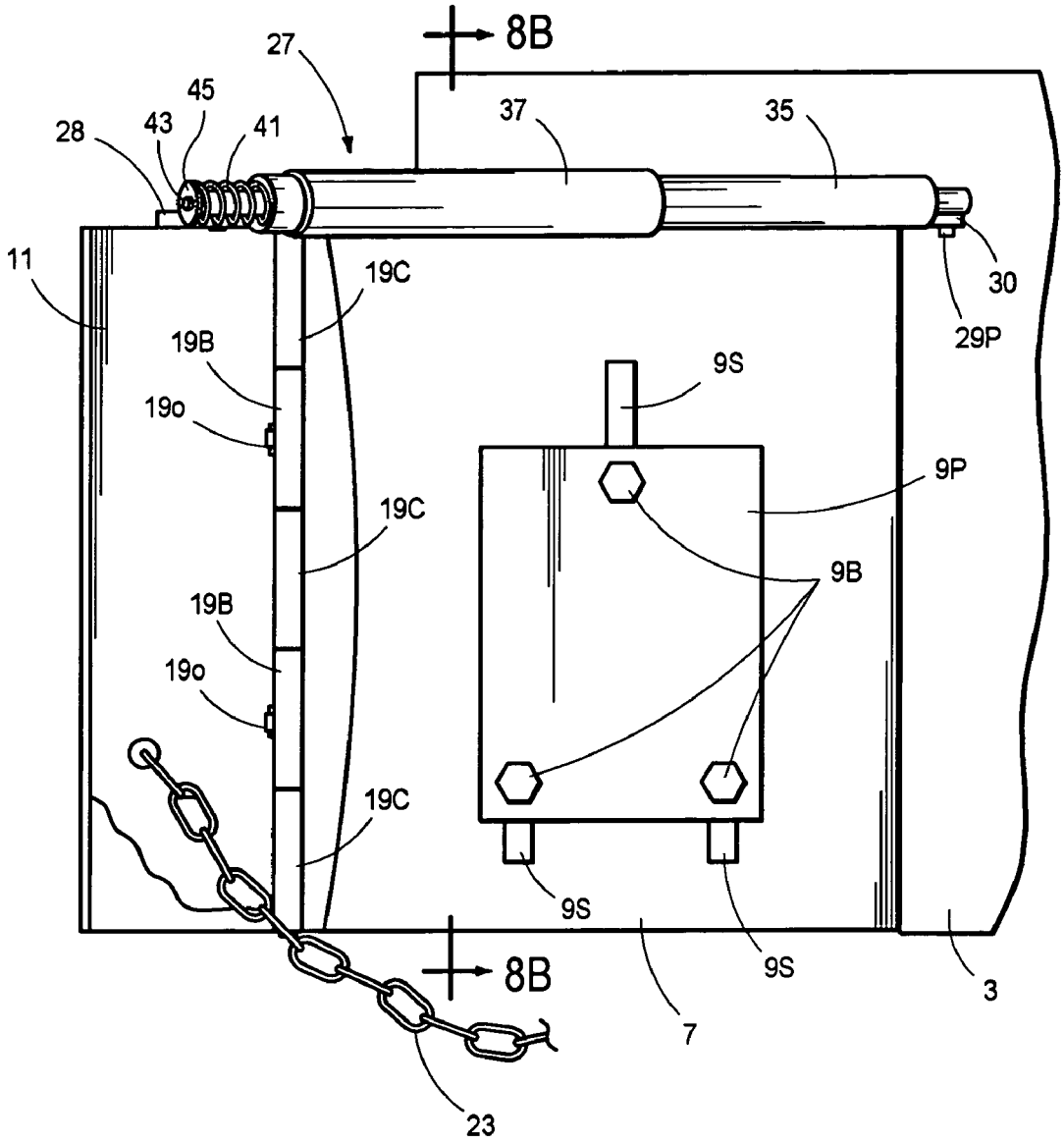
FIG. 6 is a frontal view of the boot attachment of this invention bolted to a right end of a grading moldboard.
Figure 7:
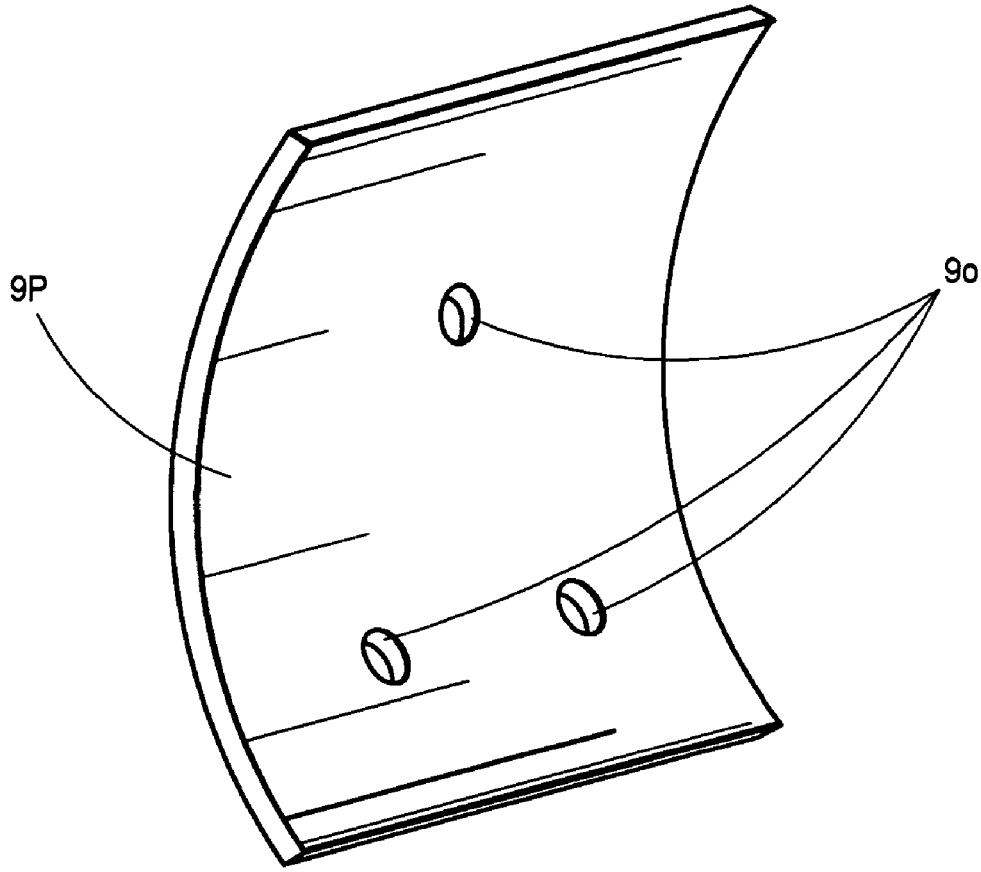
FIG. 7 is an elevational frontal view of a concave retaining plate used to secure the boot attachment to the grading moldboard.

The mounting means 9 for mounting the attachment 1 may simply comprise threaded bolts 9B adapted to secure onto a mating moldboard bolt receiving apertures 9*s* and bolt ports 9*o* as further illustrated by FIGS. 6-8. FIG. 6 depicts a frontal view of the boot attachment 1 secured onto the grading moldboard 3. This mounting may be effectively accomplished by relying upon existing bolt ports or holes commonly present in most conventional moldboards in combination with mounting plate 7 fitted with bolt retaining slots 9*s* and concave retaining plate 9P adjusted to appropriate alignment and securely bolted together with mounting bolts 9B.

A frontal view of the attachment 1 mounted to a moldboard 3 grading face is illustrated in FIG. 6. FIG. 6 depicts a concave retaining plate 9P suitably equipped with three bolt retaining ports 9*o* as portrayed in FIG. 7 which fits over the leading portion of the mounting plate 7. FIG. 8B depicts a cross-sectional view of the concave retaining plate 9P and the mounting plate 7 securely bolted onto the moldboard 3 with mounting bolts 9B. The mounting plate 7 and concave retaining plate 9P are adapted to mate onto bolt holes as commonly exist on standard grading moldboards 3 as depicted by FIG. 6 and the cross-sectional view of FIG. 8B. The three bolt retaining slots 9S of mounting plate 7 allow the grading boot attachment 1 to be adjusted so that the bottom of the attachment 1 is in alignment with the cutting edge or blade 3E of moldboard 3.

In mounting the attachment 1, the mounting bolts 9 are appropriately tightened when the mounting plate 7 is positional within the bolt retaining slots 9S so that the bottom edge of the attachment 1 rests flush with moldboard cutting edge. A grab hook 25 (sized to match the chain link 23L) welded onto the moldboard 3 serves to anchor the retaining chain 23 thereto. The hook 25 is welded square with the top edge of moldboard 3 so it will not interfere with the sonic tracker mounting pole 17 or material rolling up from moldboard 3.

The leveling gate 11 and mounting plate 7 may be suitably constructed, for example, of ½ inch thick plate steel. The mounting plate 7 may be rolled or shaped so as to conform to the configuration of the moldboard 3. The mounting plate 7 includes a strut mounting mount 30 which serves as a pivotal mounting site for mounting the strut 27 to the base mounting plate 7. The depicted leveling gate 11 includes a hinged joint 19 which permits adjustment to the desired leveling gate position. The depicted hinge joint 19 includes 5 bushings 19B & 19C welded onto the hinged section and the leveling gate 11 for receiving hinge pin 20 of approximately ¾ inch diameter. The drawings depict three bushings 19C welded to wing section 8 with the remaining two other bushings 19B being welded to the leveling gate 11. The depicted boot 1 is equipped with a compression spring 39 carried by shaft 33 and protectively housed inside a telescoping tube housing 35 & 37. The compression spring 39 applies an outward pressure upon the leveling gate 11 so as to restrain a collapsing movement of the leveling gate 11 and maintain proper positioning for operation. The telescoping housing 35 & 37 keeps the compression spring 39 from clogging with gravel and other road debris. An appropriate length of linked chain 23 (e.g. 5/16 diameter links) is shown in the Figures as being attached to the inside lower midsection area of the leading edge of the leveling gate 11. By the mounting of the chain link 23L along the lower margin of the leveling gate 11, damage to the leveling gate 11 is mitigated especially when cutting hard material or when pushing an excessively large amount of material with the leveling gate 11.

The hinge 19 is depicted as provided with two grease fittings 19*o* at each of the two bushings 19B welded onto the leveling gate 11. The hinge pin 20 permits the leveling gate 11 to swing to the desired leveling gate position. The bottom of leveling gate 11, fixed winged section 8 and mounting plate 7 are of a hard surface weld to extend wear life and keep it square. A hard surface wear weld runs on the outside lower leading corner of the leveling gate 11, where it makes contact with curb B or other finished edges to prolong its life. When the hard surface wear weld becomes worn, it should be rewelded.

What is claimed is:

1. A grader moldboard boot attachment adapted for mounting onto to a grading end of a grader moldboard carried by a motor grader and operational use in a controlled flow of graded material along a grading end of a the grader moldboard, said grader moldboard boot attachment consisting essentially of a mounting plate equipped to mount the attachment onto the grading end of the grader moldboard, a fixed winged section for moving graded material along a grading plane in substantial alignment with a grading edge of the grader moldboard with said fixed winged section extending outwardly at an obtuse angular disposition from the mounting plate so as to outwardly extend the grading end of the moldboard, an adjustable grading and leveling gate pivotally mounted to the fixed winged section, an adjustable gate retaining member for adjusting the adjustable gate to a desired open gate position while also allowing the gate to move towards a closed position and a gate restraining member operationally connected to said adjustable gate so as to apply an outwardly biasing force against said gate and maintain the adjustable gate at a desired operational grading and leveling position.

2. The grader moldboard boot attachment according to claim 1 wherein the gate comprises a hinged gate having a lower grading edge in substantial alignment with the grading plane.

3. The grader moldboard boot attachment according to claim 1 wherein the attachment includes a gate restraining member which stops the gate from movement to a closed position.

4. The grader boot attachment according to claim 3 wherein the gate restraining member includes a pivotal moldboard restraining mount at one end of the gate restraining member and a pivotal gate restraining mount at an opposite restraining member end operationally mounted to the gate restraining member.

5. The grader boot attachment according to claim 4 wherein the gate restraining member comprises a compression spring for applying an opposing outwardly biasing force against the moldboard restraining mount and the pivotal gate restraining mount so as to inhibit inward movement of the gate to the closed position when said attachment is operationally attached for use by the motor grader in a moldboard grading operation.

6. The grader boot attachment according to claim 1 wherein the adjustable retaining member comprises a linked chain and the attachment includes chain link retaining mounts for mounting the linked chain to the gate and a chain moldboard mount for mounting the linked chain to the moldboard with at least one of said chain retaining mounts being adapted to adjustably receive and retain a chain link of the linked chain.

7. The grader attachment according to claim 1 wherein the adjustable gate retaining member comprises an adjustable linkage adapted to allow inward movement and prevent outward movement of the adjustable gate from a desired outermost gate position.

8. The grader attachment according claim 7 wherein the adjustable linkage comprises a linked chain and the attachment includes a chain link hook for chaining the linked chain at the desired outermost gate position.

9. The grader attachment according to claim 7 wherein the attachment includes a gate restraining member for applying an effective counterforce against the gate so as to restrain the gate from collapsing onto the moldboard.

10. The attachment according to claim 9 wherein the restraining member comprises a compression spring for exerting the effective counterforce biasing outwardly against the gate to maintain the gate at the desired operational grading and leveling gate position.

11. A combination of a motor grader equipped with a grading moldboard and a grading boot attachment attached to the grading moldboard, said grader moldboard boot attachment comprising a mounting plate mounted to the grading moldboard of the motor grader, a fixed winged section extending obtusely outwardly from the mounting plate for moving graded material along a grading plane in substantial alignment with a grading edge of the grading moldboard, an adjustable grading and leveling gate pivotally mounted to the fixed wing for grading and leveling the graded material, an adjustable retaining member for adjusting the adjustable gate to a desired grading and leveling gate position while allowing the gate to move towards a closed position and a gate restraining member operationally connected to the adjustable gate so as to apply an outwardly biasing force against said gate.

12. The combination according to claim 11 wherein the moldboard of the motor grader is equipped with an automated sensing device for sensing and regulating grading depth of the moldboard and the attachment.

13. The combination according to claim 12 wherein the adjustable gate retaining member firmly restrains the gate from an outwardly movement from a predetermined gate retaining position while allowing for inward movement of the gate upon application of inwardly directed force upon said gate.

14. The combination according to claim 13 wherein the gate restraining member includes a compressive member for compressively applying a compressive counter force towards the inwardly directed force upon said gate.

15. The combination according to claim 14 wherein adjustable retaining member comprises a linked chain chained at one end to the gate and the combination includes a chain link retaining the linked chain at the desired gate position.

16. The combination according to claim 15 wherein the gate is pivotally mounted to the fixed wing section by a hinge.

17. A method of grading a roadbed base to a desired grade with a motor grader equipped with a grading moldboard and a mounted grading attachment comprised of a mounting plate mounted onto one end of the moldboard, a fixed grading winged section extending outwardly from the mounting plate at an obtuse angular disposition to the moldboard, an adjustable grading and leveling gate, an adjustable retaining member for adjusting the gate to a desired grading gate position while allowing the gate to move to a more closed gate position and a gate restraining member operationally connected to the gate so as to apply a desired outwardly biasing force against said gate, said method comprising:

a) ascertaining the desired gate position of the adjustable gate for the grading of the roadbed base;

b) adjusting the gate of the grading attachment to the desired gate position; and c) grading the roadbed base to a desired roadbed base grade by manipulating the moldboard and the mounted attachment so as to grade and level the roadbed base of the desired grade.

18. The method according to claim 17 wherein the boot attachment includes a grading and leveling gate restraining stop to restrain the leveling and grading gate from moving to a closed gate position and the moldboard of the motor grader is equipped with a depth sensing device for regulating elevational grading positioning of the moldboard in a roadway bed grading operation and the method comprises an additional step of regulating the elevational positioning of the moldboard by setting the depth sensing device to a desired predetermined automated signal for regulating the grading and elevational positioning of the moldboard while grading the roadbed base with moldboard and the mounted attachment positioned at the desired grading gate position.

19. The method according to claim 18 wherein the method includes the step of the grading of excessive curbside roadbed deposits from the curbside by placing the moldboard with the attached attachment at a leading edge position against the curbside so that the leveling and grading gate serves to grade material away from the curbside.

20. The method according to claim 18 wherein the grading and leveling gate is positioned to deposit graded fill along a roadway curbside and the method includes placing the moldboard with the attached attachment at a trailing edge position to the curbside so as to permit the grading and leveling gate to deposit graded fill along the roadway curbside.

* * * * *